US005180016A

United States Patent [19]

Ross et al.

[11] Patent Number: 5,180,016

[45] Date of Patent: Jan. 19, 1993

[54] APPARATUS AND METHOD FOR PLACING AND FOR BACKWASHING WELL FILTRATION DEVICES IN UNCASED WELL BORES

[75] Inventors: Colby M. Ross, Carrollton; Henry I. Restarick, Plano, both of Tex.

[73] Assignee: Otis Engineering Corporation, Dallas, Tex.

[21] Appl. No.: 743,792

[22] Filed: Aug. 12, 1991

[51] Int. Cl.[5] ..... E21B 23/04

[52] U.S. Cl. ..... 166/387; 166/194; 166/239

[58] Field of Search ..... 166/387, 120, 122, 157, 166/188, 192, 193, 194, 202, 318, 238, 239, 195

[56] References Cited

U.S. PATENT DOCUMENTS

| | | | |
|---|---|---|---|
| 2,659,438 | 11/1953 | Schnitter | 166/194 X |
| 3,211,232 | 10/1965 | Grimmer | 166/194 |
| 3,455,387 | 7/1969 | Peters | 166/278 |
| 3,552,412 | 1/1971 | Hagar et al. | 166/194 X |
| 3,912,026 | 10/1975 | Crowe et al. | 166/239 X |
| 4,635,725 | 1/1987 | Burroughs | 166/278 |
| 4,823,882 | 4/1989 | Stokley et al. | 166/387 |
| 4,893,678 | 1/1990 | Stokley et al. | 166/374 |

FOREIGN PATENT DOCUMENTS 9111587 8/1991 European Pat. Off. ..... 166/193

*Primary Examiner*—William P. Neuder

*Attorney, Agent, or Firm*—Thomas V. Malorzo

[57] ABSTRACT

An earth well completion apparatus and method wherein a work string equipped for jet washing downhole filtration devices, such as well screens and for back washing said downhole filtration devices and containing multiple ball catcher subs which utilize the same drop ball to prevent the inadvertent operation of hydraulically powered tools as well as to permanently valve closed a portion of said work string is concentrically disposed in a production string and run in said well simultaneously. Said ball catcher sub which prevents the inadvertent actuation of said hydraulically operated tools is contained within the main fluid bore of said work string and has an expellable inner collar with an outwardly biased catcher ring which, when expelled, shears hollow shearable means thereby actuating said tool. Expansion of said catcher ring frees said drop ball to fall into a catcher sub which has a retention groove milled into its inner circumference into which said drop ball extrudes thereby preventing its expulsion due to back pressure.

66 Claims, 9 Drawing Sheets

APPARATUS AND METHOD FOR PLACING AND FOR BACKWASHING WELL FILTRATION DEVICES IN UNCASED WELL BORES

FIELD OF THE INVENTION

This invention relates generally to completion techniques for use in uncased highly deviated or horizontal well bores and in particular to a method and apparatus for placing well filtration devices, such as well screen or slotted liners in an uncased hole and for backwashing well filtration devices prior to placing the well on production.

BACKGROUND OF THE INVENTION

Well filtration devices, such as well screen or slotted liner, are often difficult to place at a desired location in a well bore due to the presence of drill cuttings in the bore. In addition, those placement efforts which involve dragging or pushing such filtration devices through an uncased well bore can frequently result in partially clogging such filtration devices from the outside, thereby reducing both the production capabilities of the well and the useful life of the filtration device. Devices which provide for the removal of drill cuttings ease the spotting of well filtration devices and devices which provide for cleaning well filtration devices prior to placing a well into production are both desirable, especially if such operations can be accomplished in a single trip of pipe.

DESCRIPTION OF THE PRIOR ART

Using a float shoe which contains a plurality of ports through which fluids can be jetted to wash drill cuttings from a well bore while introducing a well filtration device into a well bore are well known in the art. However, because of the pressure intensive nature of pumping fluids down a tubing string and out through the jets at the end of the float shoe, it has heretofore been difficult to run hydraulically operated down hole well tools in the same trip because of the potential inadvertent operation of these other tools as a result of the back pressures generated in the tubing string during the jet cleaning operation. Therefore, when such operations have been conducted previously, it has been necessary to first jet the well filtration device into position in the well bore, and then, in a separate pipe trip which is costly, completion equipment and production tubing into the well to place the well in a condition to go on production.

An additional problem associated with the placement of downhole filtration devices, such as wire wrapped screen, dual concentric wire wrapped screen, commonly known as dual screen prepack screens, in which the annulus between the concentric screens has been packed with gravel, sand or epoxy coated gravel prior to its introduction in the well, or electrocoated, sintered metal tube is that such devices frequently become partially clogged by well bore debris as a result of being dragged or pushed through an uncased well bore to the proper location therein. Heretofore, there has been no capability to efficiently and cost effectively wash out such down hole filtration devices prior to placing the well in production, such washing efforts being generally limited to passing clear completion fluids over the inside and the outside of the well screen without passing any fluid through the screen to clean its porous interstices. In the prior art methods, any effort to wash out the filtration device from the inside required an additional pipe trip after the gravel pack operation to wash the well filtration device from the inside, again at great expense.

OBJECTS OF THE INVENTION

A general object of the invention is to provide a means to wash a downhole filtration device into place in an uncased well bore.

A related object of the invention is to provide a means to run down hole completion equipment into the hole simultaneously with the washing of a downhole filtration device into place without risk of causing the premature or unintentional operation of hydraulically operated tools which comprise a part or all of said completion equipment.

Another object of the invention is to provide means to backwash downhole filtration devices after they have been placed at the desired location in the well bore and a gravel pack operation has been performed.

A still further object of the invention is to provide a means to permanently plug a portion of production tubing which has been run into a well at a predetermined location in said tubing.

A further object of the invention is to provide a ball catcher which can temporarily seal a flow bore, such as that in a tool string.

Still further objects will become apparent from the following specification and claims.

SUMMARY OF THE INVENTION

The foregoing objects are achieved by the present invention in an improved down hole filtration equipment placement and backwashing apparatus having a float shoe shearably mounted within a work string and, at the same time being fixedly connected to a downhole filtration device. The float shoe has a large longitudinal port at the end of a flow bore which extends therethrough, a check valve being mounted intermediate said longitudinal flow port and said flow bore to prevent the back flow of produced fluids from being introduced into the work string. In addition, laterally extending flow ports connect a plurality of angular jets spaced about the outer circumference of said float shoe with said longitudinal port to allow the jet washing of debris from the uncased well bore to enable easy placement of downhole filtration apparatus. Once the washing operation and the placement of said downhole filtration apparatus is completed, it is desirable to install a permanent plug in the tubing string prior to back washing said downhole filtration device in order to maximize pressure through ports in the cup packer as described below.

The plugging of the work string is accomplished by using a ball catcher sub having an internal groove about its flow passage in combination with a drop ball comprising extrudable material. When said drop ball is pumped into the flow passage of said grooved sub, the ball material extrudes into said groove thereby effecting a latching engagement with said sub which is resistant to the application of back pressure thereto.

Said work string also contains well completion equipment well known in the art including a packer which utilizes a hydraulically powered setting tool, said setting tool being initially isolated from the central bore of the work string by an expendable plug shearably mounted within said bore in such manner as to temporarily plug the flow ports of said setting tool. Said shearably mounted plug is arranged to expend a drop ball after the shearing process is completed so that the same drop ball can be utilized further in the gravel packing process, including plugging the work string as aforesaid.

According to the foregoing arrangement, it is possible to run the hydraulically operated packer into the well simultaneously with the jet washing of said downhole filtration device into the desired location in the well bore without the danger of inadvertently or accidentally operating the hydraulically operated tool.

An expendable cup packer having ports connecting the bore of said work string with the annulus between the exterior wall of said work string and the interior wall of said well filtration device is also incorporated into said work string and adapted for reciprocal motion within the bore of said downhole filtration device, the sealing means of said cup packer being in slidable and sealing engagement with the inner wall of said filtration device. By reciprocally moving said cup packer within the flow bore of said downhole filtration device while pumping fluid through said ports, it is possible to back wash the filtration device from the inside thereby removing any well bore debris or drill cuttings from the pores or openings in said filtration device prior to placing said well on production.

In order to place the well on production, it is necessary to retrieve the work string from the bore of the previously installed production string which includes said downhole filtration device. However, since the diameter of the sealing means on said cup packer may be larger than the internal diameter of the bore through the hydraulic packer mounted above said cup packer, it will be difficult, if not impossible for the work string including said cup packer to be retrieved prior to placing the well on production. Therefore, a collet latch assembly has been provided to park said cup packer at the distal end of the production string prior to retrieving the work string from the hole.

It will be appreciated that the novel assemblage of tools and equipment disclosed herein will provide a relatively low cost and effective means to place downhole filtration devices at a desired location in a well bore and effectively clean a downhole filtration device prior to placing a well on production in a single pipe trip has been provided.

The novel features of the invention are set forth with particularity in the claims. The invention will best be understood from the following description when read in conjunction with the accompanying drawings.

DETAILED DESCRIPTION OF THE PREFERRED EMBODIMENT

Figures 1A, 1B:
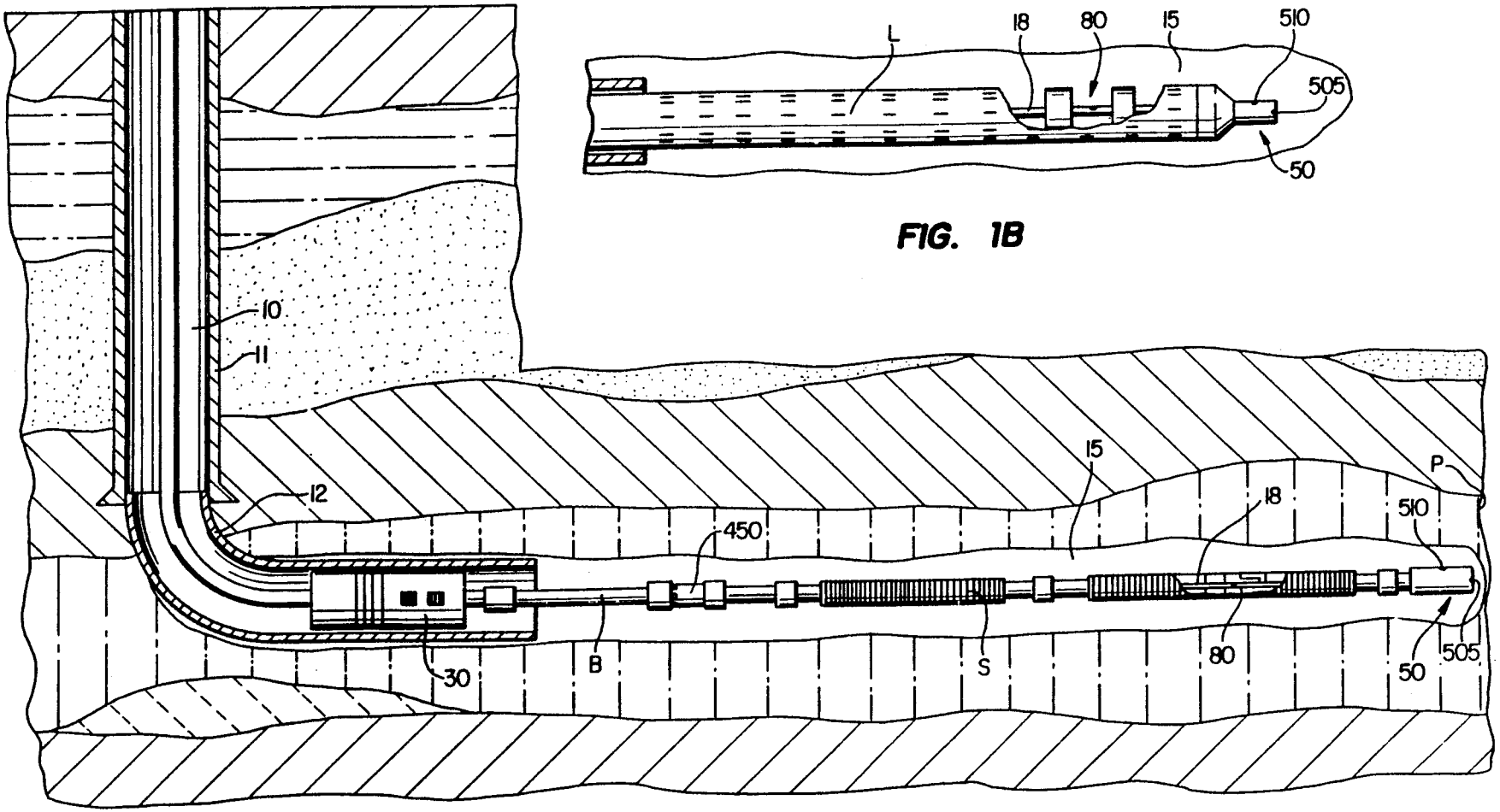
FIG. 1A is a schematic view of a well completion partially in section and partly in elevation, with a portion cut away in which the downhole filtration device is a well screen or a sintered metal tube.
FIG. 1B is a schematic view of a portion of a well completion shown in elevation, partially cut away, in which a slotted liner is used as the downhole filtration device.

In the description which follows, like parts are marked throughout the specification and drawings with the same reference numerals, respectively. The drawings are not necessarily to scale and the proportions of certain parts have been exaggerated to better illustrate details and features of the invention. Furthermore, throughout this disclosure, the letter "T" has been used to denote threaded tubular connections.

Referring now to FIG. 1A, bore hole 10 for an earth well is drilled more or less vertically through several layers of overburden and may, through the use of directional drilling motors or the like may turn from the vertical to a more or less horizontal orientation for the purpose of either placing as much of the bore hole within a producing stratum, P, or for reaching an oil producing formation remote from the vertical portion of the bore.

The vertical portion of the bore is frequently shored up against collapse by a casing which is cemented in position through which a liner 12 is run. As shown, the liner frequently only extends a portion of the length of the non-vertical portion of the well, leaving the balance of the bore as an open hole 15, which may be prone to erosion or collapse after the well is placed on production.

In order to place the well on production, production tubing which incorporates some form of downhole filtration means like that shown in FIG. 1A comprising one or more wrapped wire well screens or one or more dual concentric wrapped wire well screens having an annulus between said concentric screens which has been packed with sand, gravel or epoxy coated gravel, commonly referred to as dual screen prepack well screens, or sintered metal tubes, collectively S, are run in the uncased portion of the well bore to retard the flow of sand fines into the production tubing along with the produced fluids. For purposes of this application wrapped wire well screens, dual screen prepacks and sintered tubes will collectively be referred to as well screens. Alternatively, as shown in FIG. 1B, a slotted liner, L, may be utilized in place of or in addition to well screens.

According to the current invention, an hydraulically actuated packer 30 having retrievable hydraulic setting tool 20 shearably attached thereto is located within liner 12 and a sufficient number of lengths of blank pipe, B, are placed in the production string and threadedly attached to said hydraulic packer to allow for the proper placement of the downhole filtration device with reference to the producing formation P. Packer 30 is hydraulically connected to the earth's surface through tubular work string 18.

In a substantially horizontal well bore, the open hole 15 is frequently littered with drill cuttings, not shown, which make proper placement of the filtration means difficult. According to the current invention, a float shoe 50, described in further detail below, having a longitudinal flow passage therethrough with a lower flow port 505 at the end thereof and a plurality of lateral flow ports 510 extending from said longitudinal flow passage to the circumference of said float shoe is attached to the end of said downhole filtration device. The longitudinal flow passage of said float shoe is attached to work string 18 which is concentrically placed within the flow passage of said downhole filtration device and run concurrently therewith.

In this manner, fluid can be pumped down the work string 18 under pressure and through flow ports 505 and 510 in float shoe 50 to jet wash said drill cuttings and other debris from in front of said filtration device thereby facilitating the easy placement thereof in its desired location within the well bore.

Ported cup packer 80 is shown incorporated in work string 18 in the cut away portion of screen S and of slotted liner L in the manner contemplated in this invention.

Referring now to FIGS. 2A through 2F, the work string, including the float shoe is shown in the run in position. It is to be understood that said work string is placed within the bore of production tubing 19 so that float shoe 50 is fixedly attached either to screen S or slotted liner L and the work string is run into the hole concurrently with said production tubing as aforesaid.

Hydraulic Packer 30 is attached to hydraulic setting tool 20 by lugs 301 and shear screws 242. Setting tool 20 and Hydraulic Packer 30 are of the type disclosed in U.S. Pat. No. 4,832,129, which is incorporated herein by reference. Setting tool 20 has piston 210 guided for longitudinal movement in cylinder 212 as a result of being restrained against inner tool mandrel 215 by cylinder wall 217 and is maintained in sliding engagement therewith. Said piston is sealed against leakage of fluid power by seal means 218*a* and 218*b* mounted in grooves about piston head 220 and seal means 222*a* and 222*b* mounted in grooves about piston rod 224. Piston rod 224 has a radially inwardly sloping shoulder 226 which cooperates with inner tool mandrel 215 to form preopening chamber 228 in cylinder 212, said chamber being connected by flow port 230 to longitudinal tool string flow passage 232. Piston rod 224 is in contacting engagement with packer setting arm 236 which is slidably mounted within setting arm extension guide 238 and inner tool mandrel 215. Packer setting arm is restrained from longitudinal movement during run in by transit shear screws 240. One skilled in the art will recognize that such restraint is necessary during run in because it is possible to mechanically set a packer intended for hydraulic operation if sufficient opposing forces are generated in the tubing string during run in, especially as the tubing string is being forced through a turn or bend in the bore hole such as is illustrated in FIG. 1. Additional restraint against premature setting is provided by anti preset lug 301 which is incorporated in packer 30 and described below.

Expendable plug assembly 60 is slidably fitted into tool string flow passage 232 and supported therein by the cooperation of outwardly turned shoulder 601 of external mounting collar 605 with upper shoulder 242 of inner tool mandrel 215. The assembly is aligned within tool string flow mandrel 232 so that radially extending flow bore 603 in said plug assembly is in flow registration with flow port 230 in hydraulic setting tool 20.

Figure 6:
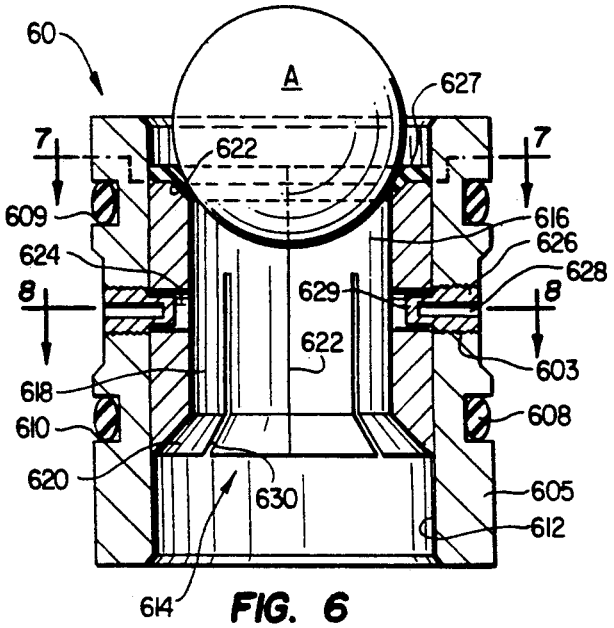
FIG. 6 is a longitudinal sectional view of the expendable plug constructed according to the present invention.
Figure 7:
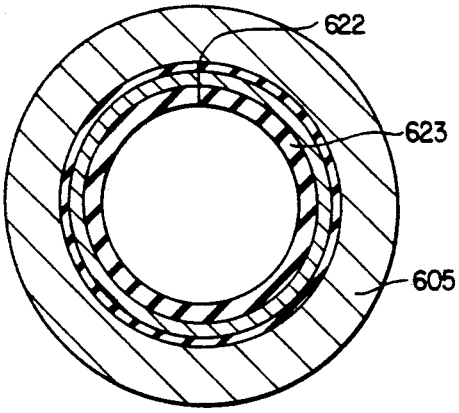
FIG. 7 is a cross sectional view of the expendable plug taken across line 7 in FIG. 6.
Figure 8:
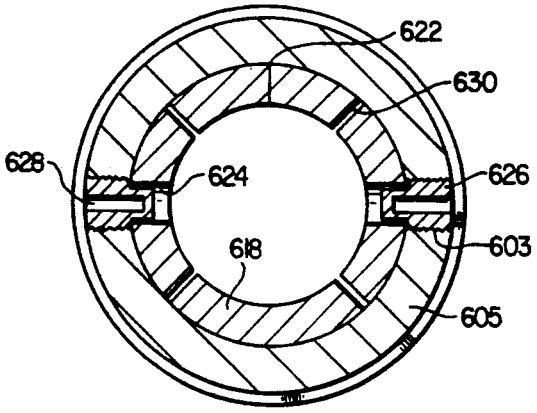
FIG. 8 is a cross sectional view of the expendable plug taken across line 8 in FIG. 6.

Referring now to FIG. 6, expendable plug 60 is comprised of a cylindrical external mounting collar 605 having at least one internally threaded radially extending flow bore 60 extending from the outside of said cylinder to the inside of said cylinder. Intermediate said flow bores and the ends of said mounting collar are sealing means, such as o-rings 607, 608 fitted into grooves 609, 610 to prevent leakage into said radially extending flow bore 603 from around the ends of said external mounting collar 605.

Compressed within longitudinal bore 612 of external mounting collar 605 is internal C-Ring 614. Internal C-Ring 614 comprises an outwardly biased ring collar 616 from which depends a plurality of resilient collet fingers 618 formed by a plurality of slots 630 cut into said collar, said fingers being rigidly bound to said ring collar at one end and left free to flex at the other, said free end terminating in a radially outwardly sloped shoulder 620. Said C-Ring has a single longitudinal slit 622 extending the entire length thereof and forming a dividing junction between two adjacent collet fingers. Said ring collar and said collet fingers combine to form a generally cylindrical shape when said ring and said collet fingers are compressed so that the opposing sides of said longitudinal slit 622 approximate each other. The end of ring collar 616 opposite said collet fingers has a radially inwardly sloped shoulder 623 which is coated with an polymeric coating 627, such as nitrile rubber, to form a seat for drop ball A. Said polymeric coating also assists in the maintenance of said outwardly biased ring collar in its circular shape as aforesaid. At a point intermediate the free ends of said collet fingers and said ring collar, there are a number of bore holes 624 corresponding with and alignable with said internally threaded radially extending flow bores 603 in said external mounting collar 605. Shearable means such as hollow shear screws 626 are threadedly engaged in said radially extending flow bores 603 in said external mounting collar 605 and extend into bore holes 624 sufficiently far enough that at least a portion of the hollow center 628 and the blind end thereof 629 extend into said bore hole.

Returning now to FIG. 2A, hydraulic packer 30 comprises inner tool mandrel 215 which extends through the longitudinal bores of both said hydraulic setting tool 20 and packer 30, and outer mandrel 302 which supports sealing element package 305, comprising three sets of elements, 305*a*, 305*b* and 305*c* which are constructed from materials well known in the art which are chosen to be compatible with the downhole environment in which they are expected to function, and opposing slips 310*a* and 310*b*.

Inner mandrel 215 is threadedly connected to production tubing 19 at its upper end and to a swivel joint 312 to allow rotation of wash pipe 401, described below, at its lower end. Threadedly connected to said swivel joint is collet type ball catcher 315 of a type well known in the art, comprising a plurality of upraised resilient collet fingers 317 and an upper sealing shoulder 319 with which said collet fingers cooperate to form a seat within which a drop ball is pumped into sealing engagement in order to provide a means to increase pressure within tool string flow passage 232.

Figure 3A:
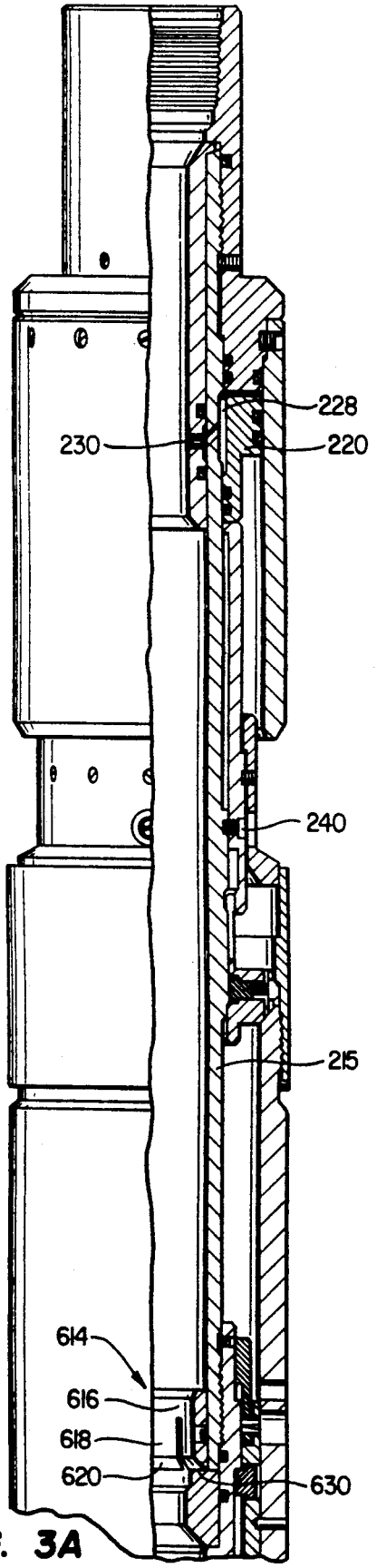
FIGS. 3A and 3B taken together is a view, partly in section and partly in elevation of the hydraulic packer, hydraulic setting tool and expendable plug according to the present invention after the flow ports of the setting tool have been opened but before the packer is set.
Figure 3B:
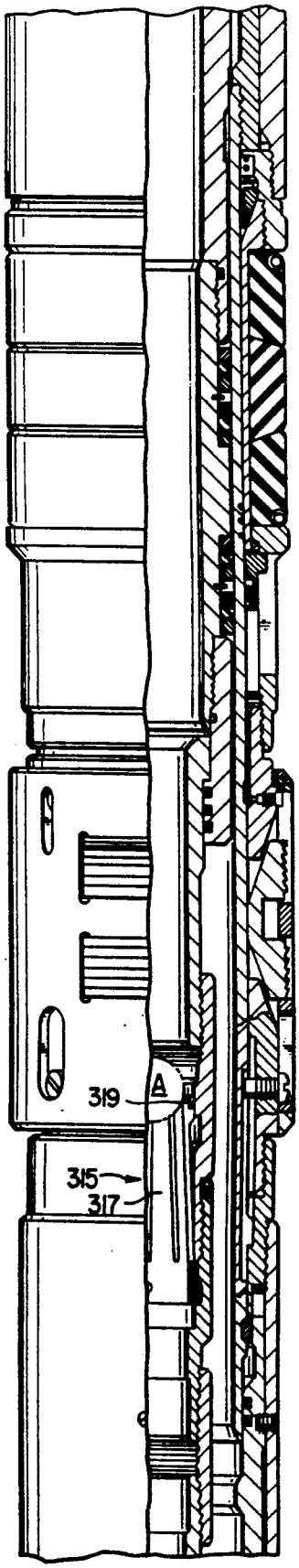

In order to set packer 30, ball A is pumped down work string 18 into sealing engagement with outwardly sloped shoulder 620 of internal collet catcher 614. Increasing the pressure in said work string forces internal collet catcher 614 downwardly into engagement with hollow shear screws 626 causing said screws to shear thereby opening the hollow center 628 thereof and creating a flow passage between tool string flow passage 232 and preopening chamber 228. Further increasing pressure in the work string causes internal collet catcher 614 to be expelled from external mounting collar 605. As is shown in FIG. 3, once collet catcher 614 clears the external mounting collar, the outwardly biased ring collar 616 is enabled to diametrically expand into contact with the inner wall of inner tool mandrel 215. The increased pressure forces the expelled collet catcher 614 and drop ball A down said inner mandrel until outwardly sloped shoulders 620 of depending collet fingers 618 contact radially inwardly stepped shoulder 630 of secondary ball seat 63. Once said contact is established, polymeric coating 627 tears along longitudinal slit 622 and C-Ring 614 expands diametrically. Drop ball A is then expelled from internal collet catcher 614 and forced further down tool string flow passage 232 into sealing engagement with collet type ball catcher 315. This action seals said flow passage above catcher 315 and allows transfer of fluid power to preopening chamber 228 through flow port 230.

Of course, one skilled in the art will recognize that it is possible for ball A to be expelled from internal collet catcher 614 before said collet catcher engages radially inwardly stepped shoulder 630 without disrupting the remainder of the process described below.

Figure 4A:
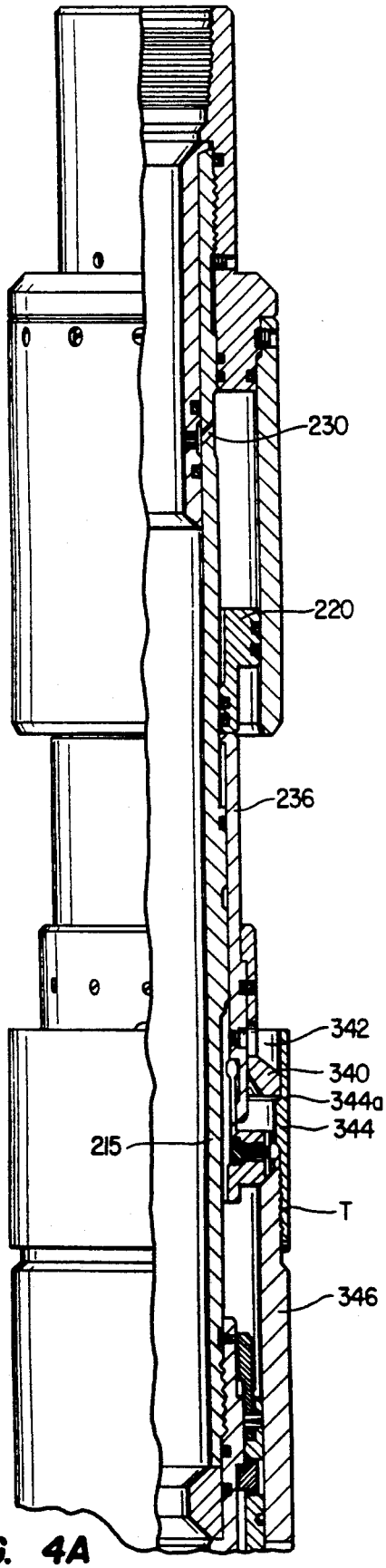
FIGS. 4A and 4B taken together is a view, partly in section and partly in elevation of the hydraulic packer and hydraulic setting tool in the set position.

Referring now to FIGS. 4 A and 4B, once Drop Ball A is landed on upraised resilient collet fingers 317 of collet catcher 315 and comes into sealing engagement with sealing shoulder 319, fluid pressure is directed through flow port 230 into preopening chamber 228. As pressure is applied to piston 220, the force generated shears transit shear screw 240 thus permitting piston 220 to longitudinally displace packer setting arm 236 and setting arm extension guide 238 attached thereto.

Setting arm extension guide 238 has wedge 340 at the lower end thereof slidably restrained within channel 342 formed by the lower end of packer setting arm 236 and tube extension guide 344. Tube guide extension 344 is threadedly connected to tube guide 346 at threaded union T and has radially inwardly stepped shoulder 344*a* which engages wedge 340 as said wedge is longitudinally displaced responsive to the longitudinal displacement of packer setting arm 236. Tube guide 346, which is free to move longitudinally with respect to inner packer mandrel 348 is threadedly connected to upper element shoe 350*a* at threaded union T.

In addition to tube guide 346 being free to move with respect to inner packer mandrel 348, upper element retainer 350*a*, element package 305, comprising three part element 305, 305*b*, and 305*c*, lower element retainer 350*b*, upper slip carrier 352, opposing slips 310*a* and 310*b* and lower slip carrier 352*a* are also free to move with respect to inner packer mandrel 348. However, downward motion of the aforementioned components in response to longitudinal motion of packer setting arm 236 is transferred to said wedge by element retainer 350 through elements 305*a*, 305*b* and is translated upwardly thereby forcing opposing angular camming surfaces 356 and 356*a* of upper wedge 352 and lower wedge 352*a*, respectively against mating camming surfaces on opposing slips 310*a* and 310*b* resulting in said slips being forced into engagement with the inner wall of liner 12. Once said slips are set against said liner, further motion of said slip carriers is prohibited and applied force is then transmitted to lower element retainer 350*b* through lower element retainer extension 358 thereby opposing the downward force exerted by packer setting arm 236 against upper element retainer 350*a*. These opposing forces compress element package 305 thereby forcing sealing elements 305*a*, 305*b* and 305*c* into sealing engagement with inner wall of liner 12.

Upper element retainer 350*a* has internal angular camming surface 350*b* which mates with a corresponding camming surface on triangularly shaped internal slip 360. The base of said slip has a serrated surface 362 which is forced into biting engagement with a roughened surface on inner packer mandrel, commonly called a phonograph finish, in response to inward forces generated by the camming engagement of the camming surfaces of upper element retainer 350*a* and internal slip 360. Said biting engagement of element locking block prevents the undesired unsetting or decompression of element package 305 and of opposing slips 310*a* and 310*b* from engagement with liner 12.

Lower wedge 352*a* is threadedly connected at union T to pin connector 364 which is in turn threadedly connected to lower packer body 366.

Referring now to FIGS. 2C through 2H, lower packer body is threadedly connected at union T to lower box connector 368 into which is threadedly inserted blank pipe B.

Tubular sleeve valve 450 of a type well known in the art, having upper box connector 451 threadedly connected to blank pipe B at threaded union T comprises an external tubular member 452 having a longitudinal flow bore 453 therethrough and connecting said upper box connector 451 and lower box connector 464. Intermediate said box connectors, a plurality of flow ports 454 connect flow bore 453 with the exterior of said valve. Tubular sleeve 456 is disposed within said flow bore 453 and adapted for reciprocal motion from a first open position wherein said longitudinal flow bore is in flow registration with the exterior of said valve to a second closed position wherein said flow registration is prevented by the positioning of said sleeve across said flow ports, said reciprocal motion being restricted between upper restraining shoulder 462*a* and lower restraining shoulder 462*b*. A plurality of seal means 458*a*, 458*b*, 458*c* and 458*d*, such as o-rings are disposed about the exterior of said tubular sleeve intermediate said ports and the ends of said sleeve to prevent leakage around said sleeve. Detent 460 is formed between raised shoulders 460*a* and 460*b* which are formed on the interior wall of said tubular sleeve.

In one embodiment of this invention, one or more lengths of blank pipe B are threadedly joined to each other in series by threaded unions T, the uppermost of said pipes being threadedly connected to lower box connector 464 and the lowermost of said pipes being threadedly connected to one or more well screens S also connected in series to each other. Of course, one skilled in the art will recognize that a sufficient number of lengths of blank pipe must be provided to position said well screen appropriately within the producing stratum P and a sufficient number of lengths of well screen S must be provided to traverse said producing stratum.

In an alternative embodiment depicted in FIG. 1B, slotted liner L could either be substituted for the lengths of blank pipe and well screen described above or positioned concentrically around well screen and run concurrently therewith.

Concentrically disposed within said blank pipe and said well screens or within said slotted liner, is wash pipe 401 which depends from hydraulic packer 30 and comprises threadedly interconnected lengths of pipe.

Fixedly attached to the exterior of said wash pipe is collet shifter 475 comprising upper collet standoff 477 and lower collet standoff 477*a*. Attached at each end to said collet standoffs is raised flexible collet 479 comprising flexible upper and lower collet members 481, 481*a* and thickened center portion 483 located intermediate said collet standoffs, said collet being adapted to ride over upper and lower raised shoulders 460*a* and 460*b* of sleeve valve 450 thereby enabling said thickened center portion to engage detent 460 on sleeve valve 450. Upward motion of work string 18 after said center portion is so engaged shifts said tubular sleeve from said first position to said second position. Of course, one skilled in the art will recognize that it is possible t substitute such a tubular sleeve which will shift upon downward motion of said work string.

Threadedly attached to said wash pipe below said collet shifter at threaded union T is inner tube 552 of telescoping joint 55. Concentrically disposed and slidably mounted about inner tube 552 is outer tube 554. Upper slide stop 556 is threadedly attached to said outer tube and lower slide stop 558 which is in slidable and sealing engagement with said outer tube is threadedly attached to the opposing end of said inner tube. Shear screw carrier 562 is threadedly engaged with internal slip 564 and cooperates therewith to retain triangularly shaped internal slip 564 within internal slip housing 566. The base of internal slip 564 has a serrated finish which enters into biting engagement with a corresponding roughened, or phonograph, finish on the exterior wall of the lower portion of inner tube 552 when s id inner tube and said outer tube are moved into extended relationship with each other as described below. On run in, inner tube 552 is maintained in a fully enclosed and retracted relationship with respect to outer tube 554 by shearable screw 560 which is threadedly inserted into bore 560*a* in shear screw carrier 562 and protrudes into screw depression 560*b* in inner tube 552.

Outer tube 554 terminates in thickened shoulder 568 which has internal enlarged diameter to receive swaged upper end 702 of shear joint 70 in sliding and sealing engagement therewith, said swaged end being restrained within said lower shoulder by shearable means 704 threadedly inserted into shear bore 570 in lower shoulder 568, said shearable means protruding into retaining hole 706 in said swaged end. Lower end of shear joint 70 terminates in box connector 708 into which is threadedly inserted at threaded joint T to upper pin connector 806*a* of cup packer 80.

Cup Packer 80 comprises a tubular mandrel 802 having longitudinal flow bore 804 therethrough and terminating in upper and lower pin connectors 806*a*, 806*b*, respectively. Intermediate said pin connectors are a plurality of flow ports 808 which connect said longitudinal flow bore with the exterior of said cup packer. Intermediate said flow ports 808 and said pin connectors 806*a*, 806*b* opposing bowl shaped sealing means 810*a*, 810*b* are fixedly and supportedly attached to the exterior of said tubular mandrel, sealing means 810*a*, 810*b* being supported on said mandrel in sliding and sealing engagement with the interior wall of production tubing 19 by L-shaped sealing means support 812*a*, 812*b* respectively. Said sealing means comprise resilient elastomeric material, such as nitrile rubber. Formed within longitudinal flow bore 804 adjacent lower pin connector 806*b* is lower ball catcher sub 90, described below, which is disposed to receive drop ball A in sealing engagement therewith and for retaining said drop ball against expulsion due to the application of back pressure to said ball.

Figure 9:
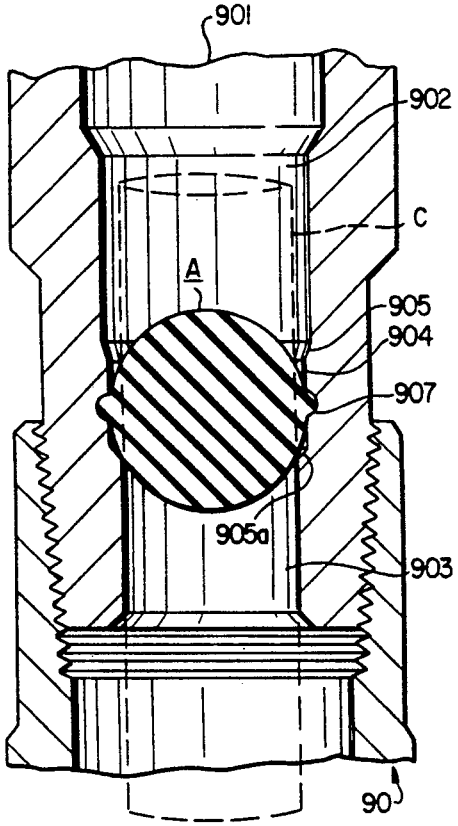
FIG. 9 is a longitudinal section of the permanent plug and drop ball constructed according to the present invention.

Referring now to FIG. 9, lower ball catcher sub 90 comprises a longitudinal bore 901 which has a first bore section 902, a last bore section 903 and at least one intermediate bore section 904. Said first bore section has a larger internal diameter than both said intermediate bore sections and said last bore section. Said last bore section has a smaller internal diameter than either said first bore section or said intermediate bore sections and each of said intermediate bore sections is of a smaller internal diameter than said section which precedes it. Each of said bore sections is connected to the next succeeding bore section by radially inwardly sloping shoulder 905, 905*a*. At least one of said bore sections has a circumferential ball retention groove 907 milled into its internal wall.

Drop ball A must be carefully chosen not only for selection of the proper diameter, but also for the appropriate material of construction since the ball must comprise a material which will extrude upon the application of pressure thereto. Therefore, drop balls made of metals with a hardness greater than 80 Rockwell B, such as steel, are not suitable for the application described below because they will not extrude into groove 907 upon application of pressure from above. Better suited to this purpose is a drop ball made from materials having a durometer hardness ranging from about 50 Shore D to 75 Shore D. Such materials include elastomers, such as urethanes, polyalkylene oxide polymers, silicone, fluorosilicone, polysulfide, polyacrylate, hypalon, Nylon 6 loaded with molybdenum sulfide, teflon, glass-filled teflon, nylon and glass-filled nylon. Also, rubbers, such as natural rubber, isoprene rubber, butadiene rubber, styrene-butadiene rubber, isobutene-isoprene rubber, chloroprene rubber, nitrile butadiene rubber and fluoro-rubber may be utilized in place of said elastomers. Especially suited for this application is a drop ball manufactured from glass-filled nylon.

Similarly, the dimensions of groove 907 are critical because it is desirable that drop ball A extrude into said groove as a result of the application of pressure from above in a manner that the groove is completely filled by the extruded ball material. If the groove is too narrow, too wide or too shallow, it is possible that an insufficient amount of ball material will be contained in said groove such that the application of back pressure from below the ball will cause the extruded material to shear from said ball thereby resulting in said ball being expelled from said catcher or that the extruded material will be of an insufficient quantity to function to prevent the discharge of said drop ball upon the application of back pressure thereto. Also, since for optimum performance it is desirable that groove 907 be completely filled with extruded ball material to provide maximum resistance to the application of back pressure, if the groove is too deep, it is possible that said groove either will not completely fill with extruded material upon the application of pressure to said drop ball or will allow excessive extrusion of the ball into the groove also resulting in possible shearing of the ball from the extruded material.

Accordingly, it is desirable that said groove be of such a width and depth that from about one third to about one half of the ball material which is exterior to an imaginary cylinder C superimposed upon said ball and having a diameter equal to the smaller diameter of radially inwardly sloping shoulder 905*a*, which forms a seat for said ball, shown in FIG. 9, is extruded thereinto.

Threadedly attached to lower pin connector 806*b* at threaded union T is latch collet 925 in which longitudinal flow bore 928, which extends the length of said latch collet, is in flow registration with longitudinal flow bore 804 of cup packer 80. Formed on the exterior wall 931 of said latch collet is resilient collet finger 930 having a lower radially outwardly sloped shoulder 932 and an upper radially outwardly stepped shoulder 934. Exterior wall 931 comprises sufficiently flexible material to allow collet finger to flex inwardly to pass over hold down ramp 955 of latch down collar 950 as described below. Lower end 936 of latch collet 925 is threadedly attached to upper collar 502 of float shoe 50.

Figure 2A:
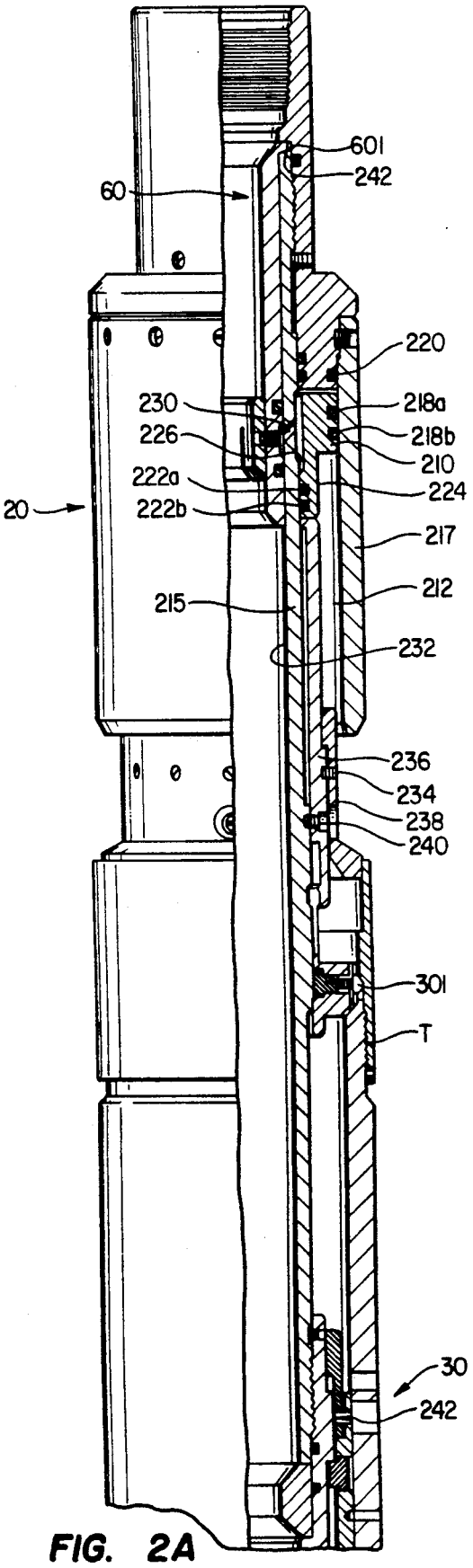
FIGS. 2A through 2H taken together is a view, partly in section and partly in elevation of the work string constructed according to the present invention as it is run in the hole.
Figure 2B:
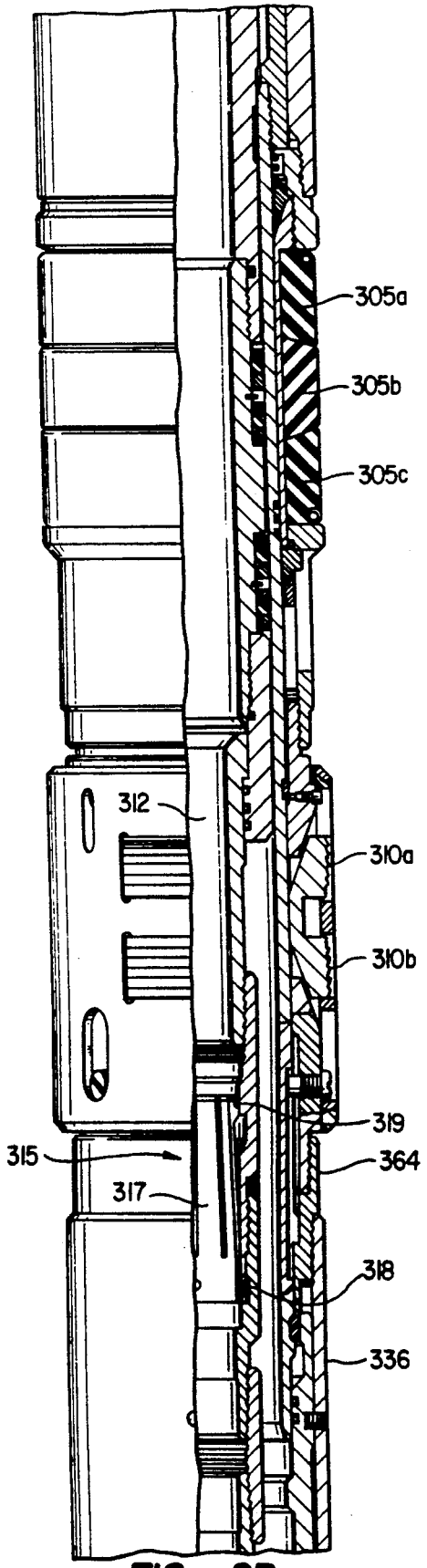
Figure 2C:
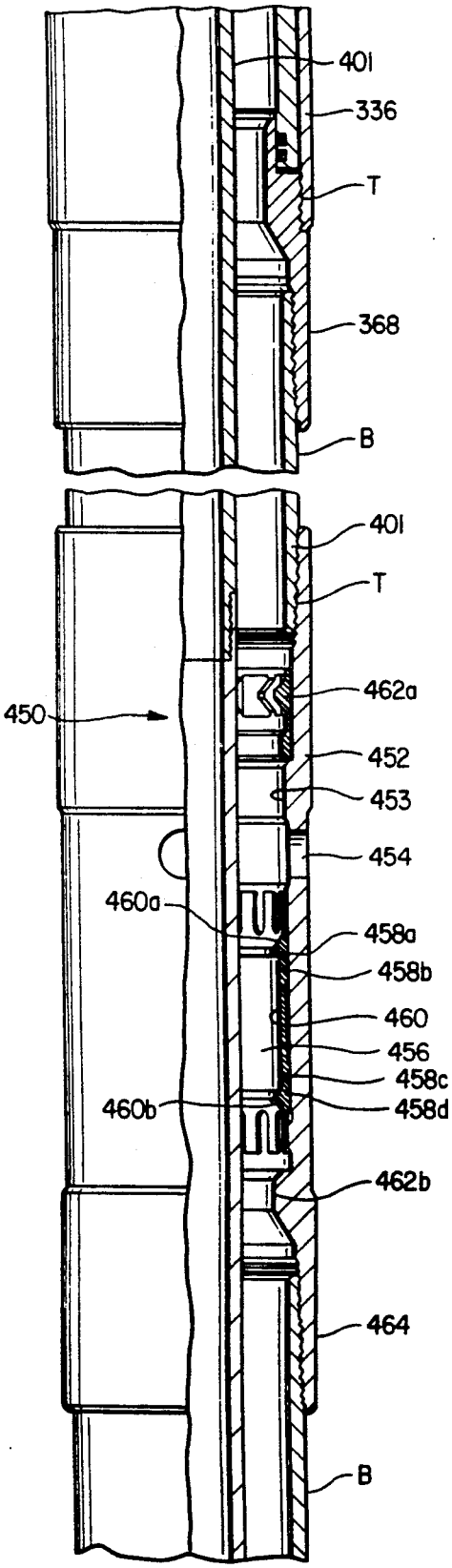
Figure 2D:
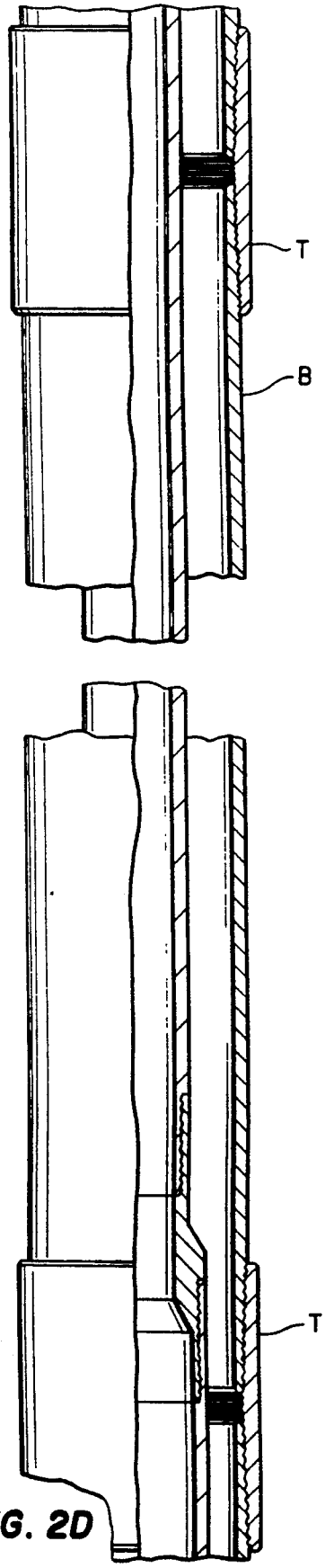
Figure 2E:
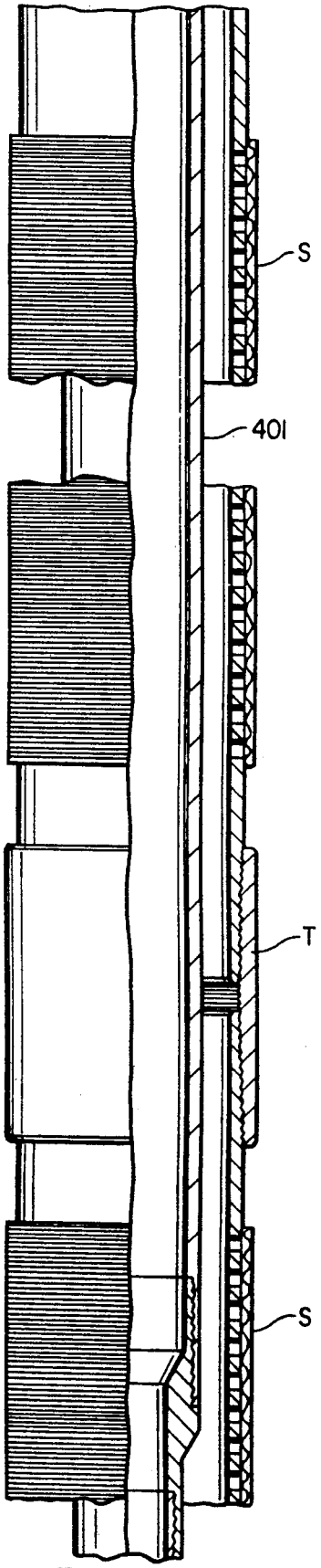
Figure 2F:
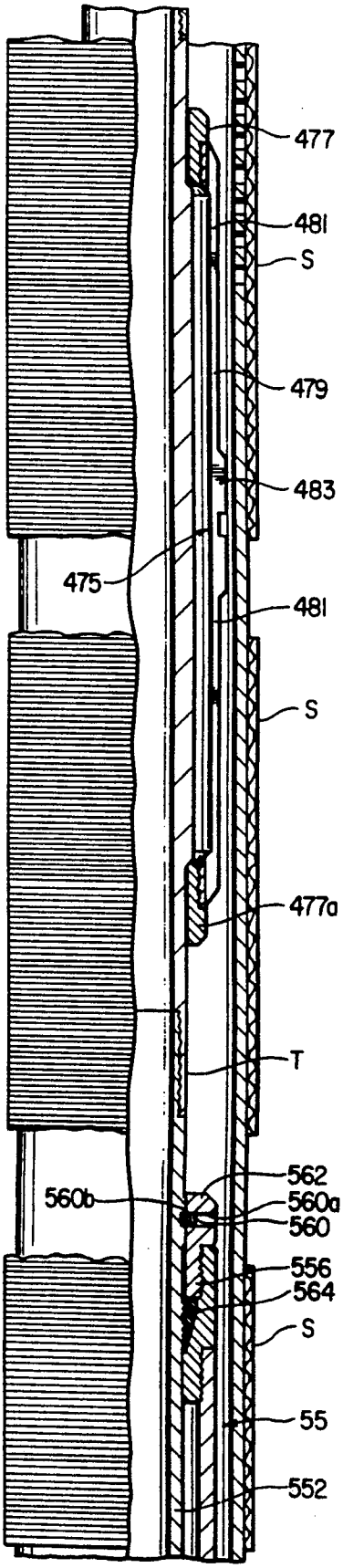
Figure 2G:
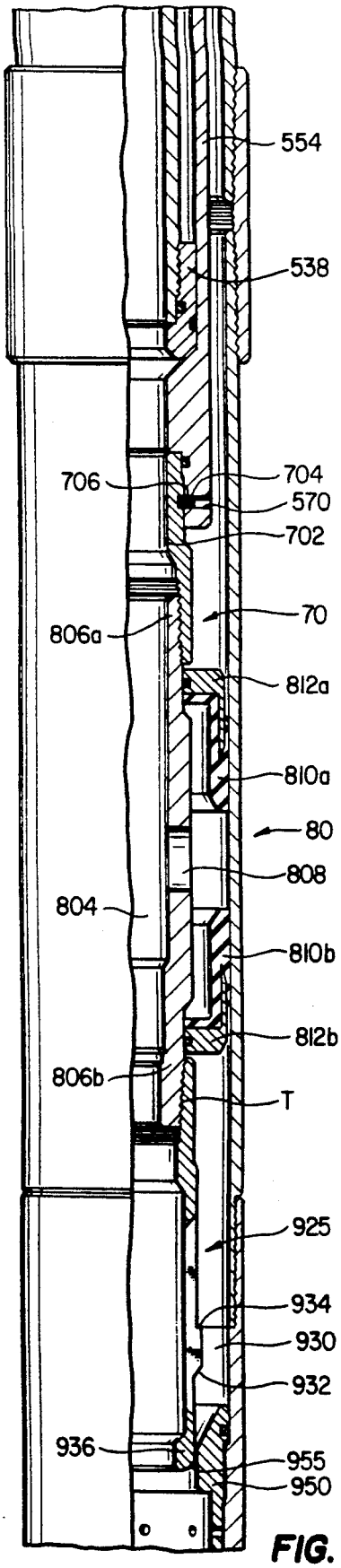
Figure 2H:
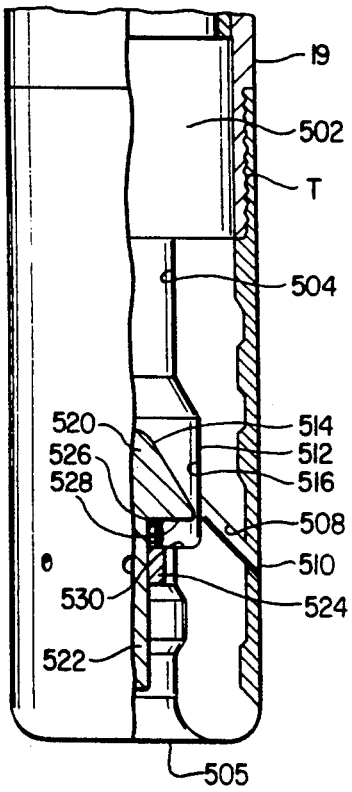

Referring now to FIG. 2H, float shoe 50 is threadedly attached to production tubing 19 at threaded union T. Longitudinal flow bore 504 extends the length of said float shoe and terminates in lower flow port 505 as aforesaid. Formed within said longitudinal flow bore is check valve 512. Check valve 512 has upper conical valve seat 514 formed as a radially outwardly sloping shoulder in flow bore 504 and a valve housing section comprising a cylindrical bore 516, said valve housing section having a plurality of radially extending flow passages 508 which terminate in lateral flow ports 510 extending therefrom. The check valve has an upper conical valve portion 520 with cylindrical valve stem 522 depending therefrom, said valve stem being slidably mounted within valve stem guide 524. Said conical valve is biased to the closed position by spring 526 which is wound around said valve stem and confined between lower flat face 528 of conical valve portion 52 and valve stem guide 524. When conical valve 520 is forced open by pressure from above, spring 526 is compressed between said lower flat face and said valve guide, said compressed spring preventing said flat face from bottoming out on lower shoulder 530 of cylindrical bore 516 thereby maintaining open fluid flow passages through both lower flow port 505 and lateral flow ports 510.

METHOD OF OPERATION

Once an earth well has been drilled and casing Il has been cemented into place, inner liner 12 is run through the bore of said casing and into the open or uncased portion of the well bore. A production tubing string 19 is assembled, which has a float shoe 50 fixedly attached at its terminal end with a latch down collar 950 threadedly attached thereto, a well filtration device such as one or more lengths of well screen S or slotted liner L, sleeve valve 450 and an appropriate number of lengths of blank pipe B are threadedly connected and hung off hydraulic packer 20. Additional lengths of blank pipe form the production tubing 19 between said hydraulic packer and the earth's surface where it is connected to a tubing hanger and ultimately to a christmas tree after the well is completed. During run in, a work string is concentrically disposed within said production string, said work string comprising, from its lower end, a latch collet 925, threadedly connected to cup packer 80 having lower ball catcher sub 90 incorporated into its flow bore as aforesaid. Threadedly connected to said cup packer is shear joint 701 which is connected by shearable means to telescoping joint 550. The upper end of said telescoping joint is threadedly connected to collet shifter 475 which is in turn threadedly connected to one end of wash pipe 401. Threadedly connected to the other end of said wash pipe is collet catcher 315 which is disposed within the bore of hydraulic packer 20. Shearably attached to the upper end of said hydraulic packer is hydraulic setting tool 20 into which is threaded an upper work string comprising blank pipe which extends to the surface. Both said production string with said work string concentrically disposed therein are run in the hole simultaneously.

As said production string begins to encounter resistance to run in as a result of debris, such as drill cuttings, left in the open portion of the hole, wash fluid is pumped down said work string under pressure. Said pressure forces open conical check valve 520 and allows said fluid to escape under pressure through lower flow port 505 and lateral flow ports 510. As the fluid is jetted through said flow ports, the debris is washed away thereby allowing said downhole filtration device to be moved into the desired position in the well bore.

Figure 4B:
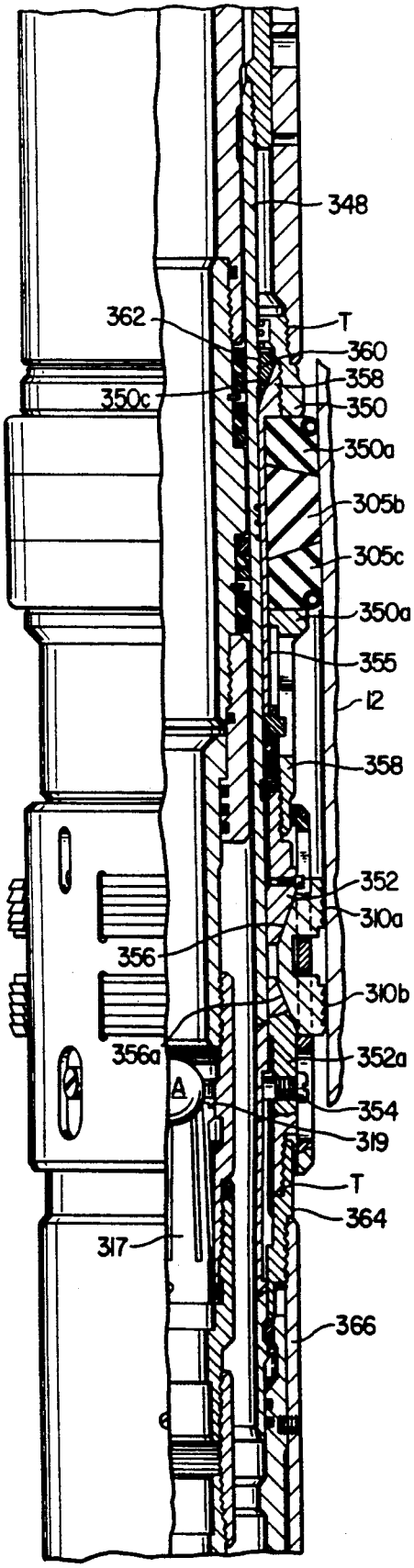

Once said production string is in the desired position, drop ball A is introduced into the bore of the work string and pumped into sealing engagement with C-Ring 616 of expendable plug assembly 60. Increasing fluid pressure on drop ball A causes bore hole 624 to press against hollow shear screw 626 which will shear upon the application of sufficient pressure thereby opening flow port 230 of hydraulic setting tool 20. Continued application of pressure upon the work string forces internal collet catcher 614 from within longitudinal bore 612 of external mounting collar 605 and allows said internal collet catcher, together with drop ball A to fall within tool string flow passage 232 until said catcher lands on shoulder 630. Continued application of fluid pressure to said ball and said collet catcher forces drop ball A into the bore of said collet catcher causing the resilient elastomeric coating on said collet catcher to tear as aforesaid, thereby releasing outwardly biased ring collar 616 to spring outwardly and release drop ball A to fall into sealing engagement upon the upwardly extending resilient collet fingers 317 of collet catcher 315 as shown in FIG. 4B. Once said drop ball is in sealing engagement with said collet fingers, further increasing fluid pressure within said work string will set slips 310*a*, 310*b* and sealing element package 305 of hydraulic packer 30 within casing 12 as aforesaid.

Although expendable plug assembly 60 has been presented as a means for isolating radial fluid power passages, one skilled in the art will readily recognize that said assembly, in cooperation with a drop ball can be used to isolate a lower portion of a main flow bore from an upper portion of a main flow bore as is well known in the art. Nothing in this disclosure is intended to restrict the use of said expendable plug assembly to one use or the other.

Figure 5A:
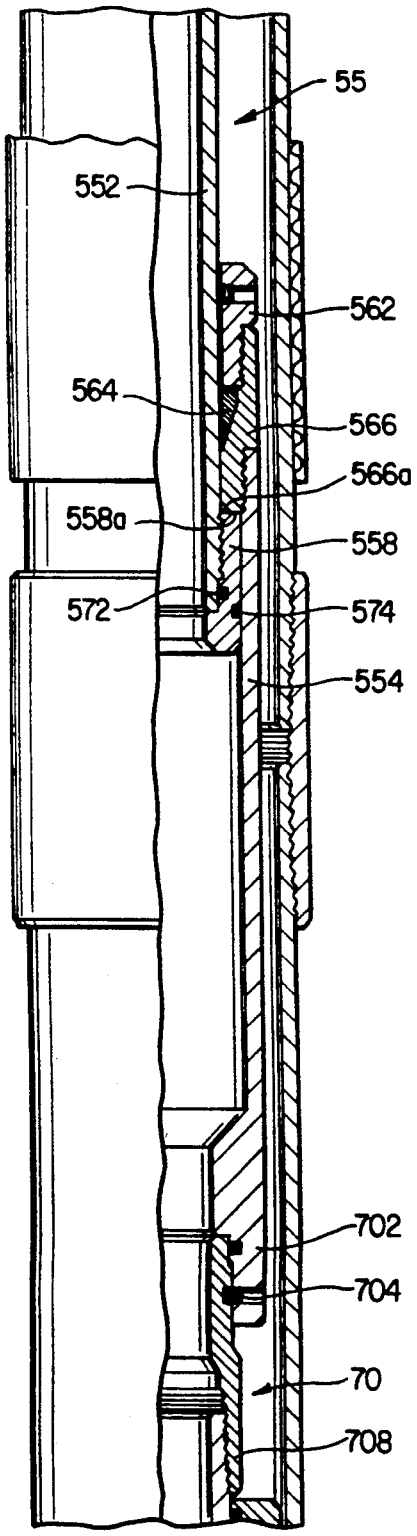
FIGS. 5A and 5B taken together is a view, partly in section and partly in elevation of the float shoe, the permanent plug and the cup packer portion of the work string constructed according to the present invention.
Figure 5B:
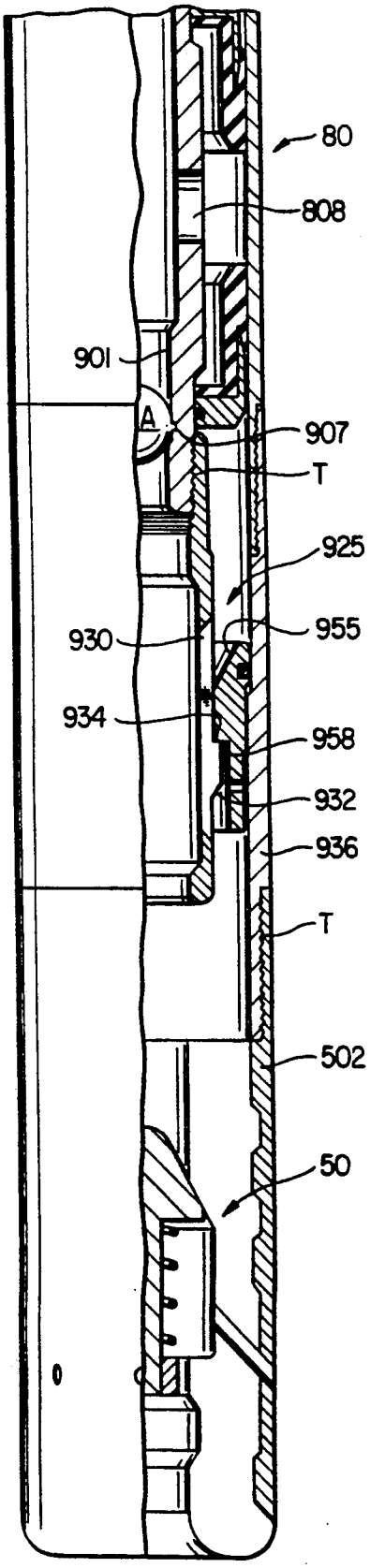

Referring now to FIGS. 5A and 5B, once hydraulic packer 30 is set, a further increase in pressure will cause shear pin 318 in the lower end of resilient collet fingers 317 of collet catcher 315 to shear and move down allowing said fingers to spread thereby expelling drop ball A further down the bore of said work string and into longitudinal bore 901 of lower ball catcher sub 90. Said increased pressure will force said drop ball into sealing engagement with radially inwardly sloping shoulder 905*a*, as is depicted in FIG. 9, and will also cause the material of drop ball A to extrude into groove 907. Completion of this sealing process, which is signaled to the operator on the surface by an increase in pump outlet pressure, will prevent the further flow of fluid through float shoe 50

Once float shoe 50 is sealed out of the system by drop ball A as aforesaid, the fluid which is being pumped through the work string is directed through flow ports 808 in cup packer 80.

Upon seeing the internal pressure rise indicating the sealing of float shoe 50 as aforesaid, the operator will begin to pick up work string 18 with all of its component parts while simultaneously pumping fluid down the work string and out through ports 808. Said pumped fluid will be forced out through downhole filtration devices, whether they be screens S, as is depicted in FIG. 1A or slotted liner L, as is depicted in FIG. IB, or a combination of the two from the inside of said device to the outside thereof. Returns are carried up the annulus between said downhole filtration device and the well bore, through ports 454 of sleeve valve 450 and thereafter to the surface in the annulus between production tubing 19 and work string 18.

As the work string is withdrawn from the production tubing, upper element support 812*a* of cup packer 80 will engage the interior bore of lower restraining shoulder 462*b* in sleeve valve 450 thereby restricting any further upward motion of the work string. This contact will be signaled to the operator on the surface by an apparent increase in weight on the rig weight indicator. Continued upward pull will shear screw 560 in telescoping joint 55. Once said screw is sheared the concentrically nested tubular portions of the telescoping joint will be pulled apart until upper slide stop 556 comes into contacting engagement with lower slide stop 560 as described below.

Referring now to FIG. 5, lower slide stop 560 is threadedly attached to inner tube 552 and is sealed against leakage by o-ring seal 572 which is carried in a groove milled into said upper slide stop and compressed between said upper slide stop and inner tube 552. Leakage between inner tube 552 and outer tube 554 is prevented by o-ring seal 574 which is contained in a second groove milled into the opposite surface of said slide stop and is maintained in sliding and sealing engagement with outer tube 554. As aforesaid, opposing radially stepped shoulders 558*a* in lower slide stop 558 and 566*a* in slide brake carrier 566 enter into restrictive engagement with each other thereby preventing the complete extraction of said inner tube from within said outer tube. Again, when said radially stepped shoulders enter into engagement with each other, the operator on the surface will be signaled that the telescoping joint is fully extended by an apparent increase in weight on the rig weight indicator.

Upon recognizing that the telescoping joint has extended, the operator will then lower the work string while simultaneously pumping fluid which exits the work string through ports 808 in cup packer 80 to continue backwashing the downhole filtration device. When lower radially outwardly sloped shoulder 932 of latch collet 925 contacts hold down ramp 955 of latch down collar 950, this event will be signaled to the operator by an apparent weight decrease. The operator will then once again raise the work string while pumping fluid until the upper sealing means support 812*a* again contacts lower restraining shoulder 462*b* of sleeve valve 450. Continued reciprocal motion of the work string between latch down collar 950 and sleeve valve 450 as aforesaid is continued while pumping fluid until a drop in indicated pump pressure at the surface indicates the downhole filtration device has been washed free of debris.

Upon completion of the washing process, the work string is once again lowered until sloped shoulder 932 of latch collet 925 is in contacting engagement with opposing hold down shoulder 958 of latch down collar 950 Additional set down weight is then applied which causes collet finger 930 to flex inwardly thereby allowing latch collet 925 to ride up and over latch down collar. Once upper radially outwardly stepped shoulder 934 of latch collet 925 clears hold down shoulder 958 of latch down collar 950, collet finger 930 is free to flex outwardly thereby forcing said shoulders into locking engagement with each other which is signified by a sudden apparent increase of applied set down weight at the surface.

After said latch collet is locked in the latch down collar, the operator applies sufficient upward force to shear shearable means 704 in shear joint 70 which frees swaged upper end 702 from box connector 708 and allows work string 18 to be withdrawn from the hole leaving cup packer 80 with lower ball catcher sub 90 retained within its longitudinal bore, and float shoe 50 down hole within the bore of production string 19. Thereafter, surface completion equipment can be installed and the well placed in production.

What is claimed is:

1. An expendable plug for inhibiting the unintentional, introduction of fluid power into a flow bore of a well completion apparatus comprising an external mounting collar having a longitudinal flow passage therethrough, mounted within said flow bore so that said flow passage is in flow registration with said flow bore; sealing means about the exterior of said collar and an internal, C-Ring comprising an outwardly biased split ring having a bore hole therethrough, said C-Ring being restrained within the bore of said mounting collar by shearable means protruding from said mounting collar into said bore hole in said C-Ring.

2. The expendable plug for inhibiting the unintentional introduction of fluid power into a flow bore of a well completion apparatus of claim 1 wherein said C-Ring is compressed within said longitudinal bore of said mounting collar.

3. The expendable plug for inhibiting the unintentional introduction of fluid power into a flow bore of a well completion apparatus of claim 2 wherein the internal C-Ring is coated with a polymer.

4. The expendable plug for inhibiting the unintentional introduction of fluid power into a flow bore of a well completion apparatus of claim 3 wherein said polymer is nitrile rubber.

5. The expendable plug for inhibiting the unintentional introduction of fluid power into a flow bore of a well completion apparatus of claim 1 wherein said shearable means are shear pins.

6. The expendable plug for inhibiting the unintentional introduction of fluid power into a flow bore of a well completion apparatus of claim 5 wherein the shearable means comprises threaded shear screws.

7. The expendable plug for inhibiting the unintentional introduction of fluid power into a flow bore of a well completion apparatus of claim 6 wherein the threaded shear screws are threadly inserted into said bores in said mounting collar.

8. The expendable plug for inhibiting the unintentional introduction of fluid power into a flow bore of a well completion apparatus of claim 1 wherein said internal C-Ring is disposed to receive a drop ball into sealing engagement therewith.

9. The expendable plug for inhibiting the unintentional introduction of fluid power into a flow bore of a well completion apparatus of claim 8 wherein said internal C-Ring is disposed to receive a drop ball into sealing engagement therewith.

10. An expendable plug for inhibiting the unintentional application of fluid power into a flow bore comprising an internal C-shaped ring compressed within the bore of an external mounting collar and restrained therein by shearable means;

said C-shaped ring comprising an outwardly biased ring having a slot therethrough said ring being compressed to approximate a circular shape and retained in said shape by confinement within a longitudinal bore in said exterior mounting collar and a plurality of resilient collet fingers formed by slots cut into said ring, said fingers being rigidly attached at one end to said ring and depending therefrom and having a resilient coating thereon;

each of said collet fingers having a radially outwardly sloping shoulder at the unrestrained end of said finger and at least one of said collet fingers having a drill hole therethrough intermediate said catcher ring and said unrestrained end thereof;

said external mounting collar comprising an essentially cylindrical tube having at least one bore hole intermediate the ends of said mounting collar said bore hole being alignable with said drill hole in said internal C-ring, and further said collar having at least one circumferential grooves in the exterior surface thereof on each side of said bore hole, each of said grooves being parallel to each other and being located intermediate said bore hole and an end of said mounting collar, each of said grooves confining an external sealing means within the boundaries thereof.

11. The expendable plug for inhibiting the unintentional introduction of fluid power into a flow bore of claim 10 wherein each of said shearable means comprise at least one hollow shear pin.

12. The expendable plug for inhibiting the unintentional introduction of fluid power into a flow bore of claim 10 wherein said shearable means comprise hollow shear screws.

13. The expendable plug for inhibiting the unintentional introduction of fluid power into a flow bore of claim 10 wherein said shearable means are positioned in said bore holes of said external mounting collar so as to protrude from said bore holes into said drill holes of said internal C-Ring.

14. The hollow shear screw of claim 12 being threadedly inserted into said bore holes of said external mounting collar and extending therefrom into said drill holes of said internal C-Ring.

15. The expendable plug for inhibiting the unintentional introduction of fluid power into a flow bore of claim 10 having said resilient seal coating of said C-Ring comprising a polymer.

16. The polymer of claim 15 comprising nitrile rubber.

17. The expendable plug for inhibiting the unintentional introduction of fluid power into a flow bore of claim 10 wherein said external sealing means comprising elastomeric o-rings.

18. The expendable plug for inhibiting the unintentional introduction of fluid power into a flow bore of claim 10 wherein said internal C-Ring is disposed to hold a drop ball in sealing engagement therewith.

19. The internal C-Ring of claim 18 wherein the internal diameter of said C-Ring is expandable upon expulsion of said C-Ring from said external mounting collar.

20. The internal C-Ring of claim 18 being disposed to hold said drop ball in releasable engagement therewith.

21. The expendable plug for inhibiting the unintentional introduction of fluid power into a flow bore of claim 10 wherein said plug is enabled to release said drop ball from sealing engagement therewith by the expansion of said C-ring.

22. The expendable plug for inhibiting the unintentional introduction of fluid power into a flow bore of claim 10 wherein said external mounting collar is fixedly aligned within said main flow bore of a tool so that said bore hole is in flow registration with a flow passage in said tool.

23. A ball catcher resistant to back pressure for sealingly and engagingly retaining a drop ball therein comprising, in combination, a plurality of interconnected flow conduit segments having the bottom flow conduit segment with a smaller internal diameter than the top flow conduit segment and at least one intermediate flow conduit segment, said intermediate flow segment having an internal diameter intermediate the segments adjacent to it, each of said conduit segments being interconnected to an adjacent segment by a radially inwardly sloping shoulder, and at least one of said intermediate flow conduit segments having a groove milled around the internal circumference thereof intermediate the ends thereof; and an extrudable drop ball having a diameter intermediate that of said top flow segment and said bottom flow segment and at least as large as said grooved intermediate flow segment, said drop ball being sufficiently soft enough to extrude into said groove upon the application of pressure thereto.

24. The ball catcher of claim 23 wherein said groove has a width and a depth sufficient to retain said ball in said intermediate flow segment.

25. The ball catcher of claim 24 wherein said internal groove is large enough to contain extruded material from about one third to about one half of the chord length of the seat diameter.

26. The ball catcher of claim 23 having at least one of said radially inwardly sloping shoulders disposed in said flow passage to receive said drop ball in sealing engagement therewith.

27. The ball catcher sub of claim 23 having said extrudable drop ball comprising material with a durometer hardness from about 50 Shore D to about 75 Shore D.

28. The extrudable drop ball of claim 27 comprising materials selected from the group of elastomers consisting of urethanes, polyalkylene oxide polymers, silicone, fluorosilicone, polysulfides, polyacrylates, hypalon, nylon, nylon 6 loaded with molybdenum sulfinde, glass filled nylon, teflon, and glass-filled teflon.

29. The extrudable drop ball of claim 27 comprising materials selected from group of rubbers consisting of natural rubber, isoprene, butadiene, styrene-butadiene, isobutene-isoprene, chloroprene, nitrile-butadiene, and fluoro rubber.

30. The extrudable drop ball of claim 27 comprising glass-filled nylon.

31. A ball catcher in combination with an extrudable drop ball which is resistant to unsealing as a result of the application of back pressure comprising:

a. a first segment having a longitudinal flow conduit therethrough;

b. a last segment having a longitudinal flow conduit therethrough, the internal diameter of said last segment flow conduit being smaller than the internal diameter of said first segment;

c. said segments being connected by at least one radially inwardly sloping shoulder;

d. a groove milled into the internal circumference of at least one of said longitudinal flow conduits; and e. an extrudable drop ball having a diameter larger than one of said grooved flow conduits and being sufficiently soft enough to extrude into said groove upon the application of sufficient pressure thereto.

32. The ball catcher of claim 31 in combination with an extrudable drop ball which is resistant to unsealing as a result of the application of back pressure wherein one or more intermediate flow segments are interconnected between said first flow segment and said last flow segment.

33. The intermediate flow conduits of claim 32 wherein the internal diameter of said intermediate flow segments is intermediate that of said first flow segment and said last flow segment.

34. The intermediate flow segments of claim 32 wherein the diameter of each flow segment is intermediate the diameter of the flow segments immediately adjacent to it.

35. The intermediate flow segments of claim 34 wherein each such flow segment is connected to the flow segment adjacent thereto by radially inwardly sloping shoulder.

36. The intermediate flow segments of claim 31 wherein the at least one of said intermediate flow segments has a groove milled into the internal circumference of said segment.

37. The ball catcher of claim 31 in combination with an extrudable drop ball wherein said extrudable drop ball comprising material with a durometer hardness from approximately 50 Shore D to approximately 75 Shore D.

38. The extrudable drop ball of claim 37 comprising materials selected from the group of elastomers consisting of urethanes, polyalkylene oxide polymers, silicone, fluorosilicone, polysulfides, polyacrylates, hypalon, nylon, nylon 6 loaded with molybdenum sulfinde, glass-filled nylon, teflon, and glass-filled teflon.

39. The extrudable drop ball of claim 37 comprising materials selected from group of rubbers consisting of natural rubber, isoprene, butadiene, styrene-butadiene, isobutene-isoprene, chloroprene, nitrile-butadiene, and fluoro-rubber.

40. The drop ball of claim 37 comprising glass-filled teflon.

41. The ball catcher of claim 31 wherein said flow segments are interconnected by radially inwardly sloping shoulders.

42. The ball catcher of claim 31 wherein said groove has a width and a depth sufficient to retain said ball in said intermediate flow segment.

43. An apparatus for backwashing downhole filtration means comprising a cup packer having a tubular central mandrel with flow ports connecting the inside of said tubular mandrel with the annular space between said tubular mandrel and the inner wall of said filtration means, sealing means arranged upon said mandrel intermediate said flow ports and the end of said mandrel, latching means on said mandrel and means for sealing the flow conduit in said mandrel below said flow ports, said cup packer being attached to a work string by shearable means and said apparatus being disposed for reciprocal motion within and sealing engagement with the inner wall of said filtration means.

44. The apparatus for backwashing downhole filtration means of claim 43 wherein said sealing elements are of a bowl shaped construction.

45. The sealing elements of claim 44 being arranged on said mandrel so the interior of said bowl is nearer said flow ports than the base thereof.

46. The sealing elements of claim 44 comprising a resilient elastomer.

47. The resilient elastomer of claim 46 comprising nitrile rubber.

48. The apparatus for backwashing downhole filtration means of claim 43 wherein said sealing means comprises a ball catcher sub having a ball retention groove milled into the inner wall of said sub perpendicular to the longitudinal axis of a flow conduit passing through said catcher sub and a shoulder disposed for receiving a drop ball in sealing engagement therewith within said flow conduit and intermediate said groove and the lower end of said sub.

49. The apparatus for backwashing downhole filtration means of claim 47 wherein said latching means cooperates with a locking means on said downhole filtration means to fixedly retain said apparatus downhole after the completion of said backwashing.

50. An apparatus for backwashing downhole filtration means which are incorporated into a production string having a latch down collar proximate the terminal end thereof into position and for backwashing said downhole filtration devices comprising, in combination, from bottom to top, a. a float shoe having a longitudinal flow conduit therethrough, said flow conduit having a smooth bore at the one end thereof, a plurality of axially extending jet washing ports depending therefrom and a jet washing port at the terminal end thereof, said float show being rigidly attached at said terminal end to the end of said downhole filtration means so that said washing ports protrude from said filtration means;

b. latch collet sub being stung into said float shoe and having a longitudinal flow passage therethrough and an external collet latch intermediate the ends of said sub, said collet latch comprising a lower radially outwardly stepped shoulder, said radially outwardly stepped shoulder being adapted to positively engage and latch together with a corresponding radially inwardly stepped shoulder in said latch down collar;

c. ball catcher resistant to back pressure for sealingly and engagedly retaining a drop ball therein threadedly connected to said latch collet, said ball catcher sub having a flow passage therethrough said flow passage being in flow registration with the longitudinal flow passage of said latch collet sub connecting a first upper opening and a second lower opening and having a decreasing diameter therebetween, a ball retention groove milled into the inner wall of said flow passage intermediate said first opening and said second opening and a radially inwardly sloping ball seat intermediate said ball retention groove and said second opening;

d. a cup packer threadedly connected to said ball catcher sub, said cup packer having a central mandrel with a longitudinal flow passage therethrough, a plurality of flow ports connecting said flow passage to the annular space between the exterior of said mandrel and the interior of said production string and two opposing essentially hollow bowl shaped sealing elements means, each of said elements extending from and being supported by said mandrel such that said plurality of flow ports are intermediate said element means and being oriented so that the bases of said cones face each other, the sides of said bowl shaped element means being in slidable and sealing engagement with the interior wall of said filtration means, and e. a shear sub having a first threaded end, a second swaged end and a flow passage connecting said first end with said second end, said shear sub being threadedly attached to said cup packer and being attached to the balance of the work string thereabove by shearable means.

51. The apparatus for washing downhole filtration means into position and for backwashing downhole filtration means of claim 50 wherein said downhole filtration means comprise well screen.

52. The well screen of claim 51 comprising wrapped wire screen.

53. The well screen of claim 52 comprising dual concentric wrapped wire well screens with an annulus therebetween, said annulus having particulate material packed therein.

54. The well screen of claim 53 wherein the particulate material is chosen from the group comprising gravel, epoxy coated gravel or sand.

55. The particulate material of claim 54 comprising epoxy coated gravel.

56. The apparatus for washing downhole filtration means into position and for backwashing downhole filtration means of claim 50 wherein said downhole filtration means comprises electropolished sintered metal tube.

57. The apparatus for washing downhole filtration means into position and for backwashing downhole filtration means of claim 50 wherein said downhole filtration means comprise slotted liner.

58. The apparatus for washing downhole filtration means into position and for backwashing downhole filtration means of claim 50 wherein said cup packer is adapted for reciprocal motion within said filtration means.

59. A method for completing a partially cased, highly deviated or horizontal well bore comprising:

a. assembling a production string consisting of a ported float shoe having a latch down collar incorporated therein threadedly connected to a plurality of threadedly interconnected well filtration devices, a sleeve valve, a hydraulically operated well packer and a sufficient number of lengths of tubing to reach the surface of said well;

b. concentrically disposing within said production string a work string consisting of a latching collet in flow registration with the flow conduits of said float shoe and being threadedly connected to an anti-blow back ball catcher sub which is in turn threadedly connected to a cup packer having ports connecting the internal bore of said packer with the annulus between said packer and the inner wall of said production string and opposing conical elements disposed on either side of said ports, said cup packer being threadedly connected to a shear joint onto which is slidably and shearably attached a telescoping joint having concentric flow tubes, one being slidably mounted within the other and said tubes being lockable in a fully expanded condition, said expansion joint being threadedly connected to a collet-type ball catcher sub, said ball catcher sub being threadedly connected to a hydraulic setting tool, said setting tool being disposed in engageable relationship with said packer to effect the setting thereof and said setting tool having a ball actuated valve in sealing engagement with the flow ports of said setting tool and sufficient lengths of interconnected tubing to reach the earth's surface;

c. running said production string and said work string into the well bore as a unit and pumping wash fluid through said work string into said well bore through said ports in said float shoe to remove debris from said well bore;

d. positioning said production string at the desired location in said well bore while maintaining said packer within the cased portion of said well bore and thereafter ceasing the pumping of said wash fluid through said work string;

e. dropping an extrudable ball into said work string and pumping fluid down said work string to force said ball into engagement with said ball actuated valve;

f. increasing the pressure applied to said valve and said ball sufficiently to shear hollow shear pins therein thereby simultaneously expending an internal collet catcher from the external mounting collar of said valve and opening flow ports in the packer setting tool;

g. further increasing the pressure applied to said ball to expend said ball from said internal collet catcher into sealing engagement with a second collet catcher;

h. applying pressure sufficient to stroke a piston in said setting tool thereby moving the slips of said packer into binding engagement and the seals of said packer into sealing engagement with the casing of said cased portion of said well bore;

i. further increasing the pressure within said work string to both expel the drop ball from said second collet catcher sub into sealing engagement with an anti-blow back ball catcher sub and to extrude said drop ball into a ball retention groove within said anti blow-back ball catcher sub thereby isolating the flow ports in said float shoe from the remainder of said work string;

j. simultaneously pumping wash fluid down said work string and through the ports in said cup packer while manipulating said work string to reciprocate said cup packer within the bore of said well filtration devices until said wash fluid flows freely therethrough;

k. pulling up on said work string until the upper shoulder of said cup packer is brought into engagement with a packer retention shoulder and continuing said upward pull until said telescoping joint is locked into its fully extended position;

l. pushing down on said work string until said latching collet is restrainedly engaged by said latch down collar;

m. applying sufficient upward force on said work string to shear the shearable means in said shear joint;

n. withdrawing that portion of said work string above said cup packer from the bore of said production string; and o. attaching such accessory and surface equipment to said production string to place the well in production.

60. The method for completing a partially cased, highly deviated or horizontal well bore of claim 59 wherein said well filtration device comprises well screen.

61. The Well screen of claim 60 comprising wire wrapped screen.

62. The wire wrapped screen of claim 61 comprising dual concentric wire wrapped screens with an annulus therebetween, said annulus having particulate material packed therein.

63. The particulate material of claim 62 being chosen from the group comprising gravel, epoxy coated gravel and sand.

64. The particulate material of claim 63 comprising epoxy coated gravel.

65. The method for completing a partially cased, highly deviated or horizontal well bore of claim 59 wherein said well filtration device comprises electropolished sintered metal tube.

66. The method for completing a partially cased, highly deviated or horizontal well bore of claim 59 wherein said well filtration device comprises slotted liner.

* * * * *

UNITED STATES PATENT AND TRADEMARK OFFICE

CERTIFICATE OF CORRECTION

PATENT NO. : 5,180,016
DATED : January 19, 1993
INVENTOR(S) : Ross, et. al.

It is certified that error appears in the above-indentified patent and that said Letters Patent is hereby corrected as shown below:

On the cover page, item [54], "HENRY I. RESTARICK" should read -- HENRY L. RESTARICK --.

At column 4, line 41, "casing which is cemented" should read -- casing 11 which is cemented --.

At column 6, line 12, "flow bore 60" should read -- flow bore 603 --.

At column 11, line 43, "conical valve portion 52" should read — conical valve portion 520 --.

At column 11, line 54, "casing I1" should read -- casing 11 --.

In Claim 1, lines 1-2 (column 14, line 36-37), "unintentional, introduction" should read -- unintentional introduction --.

In Claim 1, line 8 (column 14, line 43), "internal, C-Ring" should read — internal C-Ring --.

In Claim 14, line 1 (column 15, line 61), "hollow shear screw" should read -- hollow shear screws --.

Signed and Sealed this

First Day of February, 1994

Bruce Lehman

*Attest:*

BRUCE LEHMAN

*Attesting Officer*

*Commissioner of Patents and Trademarks*